United States Patent [19]

Byron

[11] 4,209,171

[45] Jun. 24, 1980

[54] GAME UTILIZING A GAME IMPLEMENT

[76] Inventor: Michael N. Byron, 807 S. Curson Ave., Los Angeles, Calif. 90036

[21] Appl. No.: 935,277

[22] Filed: Aug. 21, 1978

[51] Int. Cl.[2] ..... A63F 9/18

[52] U.S. Cl. ..... 273/161

[58] Field of Search ..... 273/161, 1 F; 43/23; 124/5

[56] References Cited

U.S. PATENT DOCUMENTS

| | | | |
|---|---|---|---|
| 1,914,449 | 6/1933 | Murray | 124/5 |
| 2,803,087 | 8/1957 | Zalkind | 273/1 F |
| 2,826,859 | 3/1958 | Shaffer | 272/8 NX |
| 2,835,245 | 5/1958 | Morgan | 43/23 X |
| 2,868,542 | 1/1959 | Mieg | 273/1 F |
| 4,113,253 | 9/1978 | Huston | 273/96 R |

*Primary Examiner*—Anton O. Oechsle

*Attorney, Agent, or Firm*—Harry R. Lubcke

[57] ABSTRACT

A game utilizing a game implement that is sensitive to motion and is lightly held in the hand of an operator. Involuntary reaction of the operator causes the free end of the game implement to move. Such movements as occur may be considered as evidencing an informational reply. The game implement is an elongated nonmetallic device having a handle to be lightly grasped, a flexible rod, and an orb or body having mass, which latter describes the movement.

9 Claims, 4 Drawing Figures

GAME UTILIZING A GAME IMPLEMENT

BACKGROUND OF THE INVENTION

The invention pertains to what may be termed a parlor game for adults and interested children, in which a game implement is sensitively manipulated.

Certain prior art games have depended upon sensitive involuntary reaction of the participant.

One such game is that disclosed in the U.S. Pat. No. 3,104,494 as illustrated in FIGS. 1 and 2 thereof. Horizontal movement of two freely pivoted rods held in the hands of the participant occurs.

BRIEF SUMMARY OF THE INVENTION

The game implement is a flexible wand having a handle, flexible elongated rod, and a weighted orb upon the free end of the rod.

It is lightly held in an approximately horizontal attitude by a participant of the game.

Presumed reaction to matter or circumstances is involuntary on the part of the participant. It is indicated by movement(s) of the orb at the end of the implement.

DESCRIPTION OF THE PREFERRED EMBODIMENTS

Figure 1:
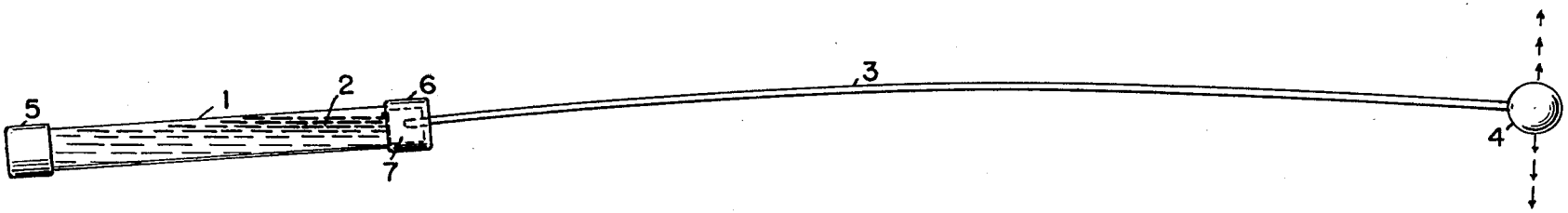
FIG. 1 shows the game implement in side elevation, with a motion of the orb indicated by successive arrows.

The game implement is shown assembled in a basic embodiment in FIG. 1. It is comprised of handle 1, having liquid 2 inside of the same, and a wand extending coaxially from the handle and consisting of rod 3 and orb 4. The rod is sufficiently flexible to bend in a smooth arc having a sagitta (departure from a straight line at the center of the rod) of approximately 3 centimeters (cm). This provides appropriate sensitivity to motion for the orb, in use.

In the basic embodiment, at least, the implement is constructed of what is generically known as "plastic", and not of metal.

Handle 1 is typically a hollow transparent cylindrical tube, having an outside diameter of 1.5 cm, with a wall thickness of 1.5 millimeters (mm), and a length of 14 cm. Insofar as being held in the hand, the handle is rigid.

Extruded acrylic or polycarbonate tubing, clear, is a suitable material.

A cap 5 fits over the bottom end of the tube; and it attached thereby. Preferably it is sealed to be liquid-tight by a clear adhesive, which may be silicone rubber sealant, by Dow-Corning.

A second cap 6 fits over the top end of the tube.

A resilient plug 7, which may be of cork, is provided to seal-in liquid 2; and also to accept an end of rod 3, to form a rigid structure. The above-mentioned adhesive is employed to permanently join these parts.

The tube-handle is filled with liquid 2 to approximately 90% of the internal volume. When held approximately horizontal this results in an elongated bubble approximately 3.5 cm long. The bubble has the appearance of that of a liquid level, normally used to determine if the structural elements of buildings are horizontal. In the present instance a particular location of the bubble along the tube-handle indicates at what small angle to the horizontal the handle is being held by the operator.

The chief ingredients of the liquid are distilled water and glycerol. Slightly more than 10 cubic centimeters (cc) of liquid is required for each handle. Of this, 9.75 cc is distilled water and 0.25 cc is glycerol.

It is usual to add a coloring material. Two cubic millimeters; i.e., 2 microliters, of Schilling's color is suitable.

It is desirable to homogenize the liquid, and this can be accomplished, in effect, by adding a very small quantity of acetic acid, which may be about 0.2 microliters of white vinegar.

Rod 3 is preferably of polycarbonate plastic, 40 cm long and 3 mm in diameter, being essentially clear (transparent). It is typically cemented into resilient plug 7 that has been previously described.

The typical orb or body 4 is a clear plastic sphere, of acrylic or polycarbonate, having a diameter about 2 cm. It may have a hole extending inward about 2 mm to snugly receive rod 3; and be cemented thereto by a plastic-to-plastic adhesive, such as Well Done #16, clear thickened cement for acrylic, as manufactured by Industrial Polychemical Services.

When thus constructed the implement has a long life; with nominal care, a lifetime.

Figure 2:
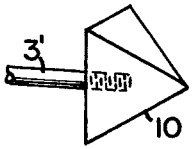
FIG. 2 is a fragmentary showing of a body of alternate pyramidal configuration.

FIG. 2 illustrates a body 10 of pyramidal shape, which may have a dimension along the base at one side of 2 cm.

A further alternate construction is shown in FIG. 2, and this is a threaded rod 3', which engages corresponding threads in the center of the base of the pyramid. With the threaded construction on orb and rod, various shaped orbs can be substituted at will.

Figure 3:
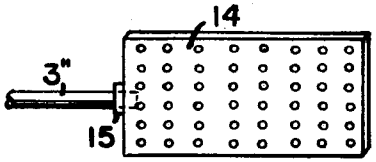
FIG. 3 is the same with a perforated paddle configuration.

FIG. 3 illustrates a body 14 of perforated paddle shape, which may have dimensions of approximately 4 cm long, 2 cm wide, and 2 mm thick. Typically, 48 perforations approximately 1 mm diameter may be regularly or irregularly arranged.

A still further alternate construction is shown in FIG. 3, in which rod 3" is a force fit into hub 15 of the paddle. With this construction suitably constructed orbs may also be substituted.

An alternate total construction may employ a single polycarbonate or equivalent plastic moulded implement. A heat-sealable plug is provided to allow introduction of the liquid into the handle and then to hermetically seal it.

Figure 4:
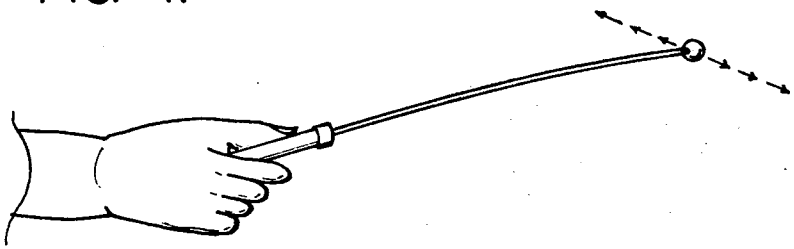
FIG. 4 shows the game implement held in the hand, with another motion of the orb indicated.

In use, the implement is held gently in the operator's hand, right or left depending upon the individual, in an approximately horizontal position, as shown in FIG. 4, which is in perspective. An opposite position of the hand, with the palm upwards and the fingers on one side of the handle with the thumb on the other, may also be used.

The wand should point forward. The arm should be at the side with the elbow bent and the handle about 15 cm from the body, with the hand held just above the waist. The operator may be standing or sitting.

The implement should be held stationarily until the orb is substantially motionless. Any valid response should thereafter come with the operator continuing to relaxedly hold the handle.

Such a response should be of significant amplitude, and may be up and down, sideways, or circular; even repetitively irregular.

The significance to any motion is subject to wide interpretation. Specific significance may be pre-chosen, as in the parlor game to follow.

The parlor game is played by a minimum of three persons. The one who holds the game implement is termed the "responder". A second person is the "emitter", and a third person is the "control". The "responder" may also be termed the "chosen participant".

The "control" secretly makes a list of a related sort, such as five objects in the room, five colors, five integers chosen from 1 through 9, five first names, or five months of the year. He keeps this list confidential to himself until the end of the game vs. the "emitter".

The "responder" person sits quietly in another room, holding the implement in the hand he normally uses to write with, etc. His elbow is bent and is near his body. He does not cross his legs and his two hands do not touch. He gazes at the orb, giving it his concentration; making a decision that, for instance, a motion of the orb up and down shall indicate "yes", and that a motion sideways shall indicate "no". Specific meanings can also be given to revolution clockwise and counter-clockwise.

The "emitter" person is given a piece of paper on which one of the five items chosen in a given class have been written by the "control". The "emitter" retires to another room.

The "responder" person is given a list of the five objects by the "control" person, and retires to a room away from that occupied by the "emitter".

When all are ready, the "emitter" is instructed to concentrate his thought, by the "control" person, upon the single object on the slip of paper that he was given by the "control" person.

The "responder" person is to concentrate on the orb of the implement as he slowly and deliberately also concentrates on one of the objects at a time, interrogating the orb in his mind as to which is the one that the "emitter" is mentally concentrating upon.

According to the rule of the game, when the "responder" believes he has obtained an affirmative answer from the implement, by the orb moving in the manner decided upon as being "yes", then he comes back to the "control" person and makes his decision known.

He may be correct, or he may be incorrect, depending upon various circumstances. Should he be correct, all concerned share an excitement and a satisfaction that is the appeal of the game.

The procedure may be repeated for another item on the list.

Subsequently, the game is repeated with different participants taking different parts and new lists employed.

The game is scored by how many correct answers each person obtains when he acts as the "responder".

Two or more teams of three persons each may play, with interteam rivalry.

Also, the game may be informally played with two or more participants, in which all of the players stay together and the question is mutually "asked" of the orb. This may be any question that is of interest to one or more in the group. The answer may be "yes", "no", or indecisive. The questions may be of party flavor, such as, "Will John ever become a millionaire", or "Will Mary be married this year?"

No attempt is made herein to postulate by what mechanism the implement responds. The person operating it is to be fully relaxed and is in no way to consciously move the handle. Thus, any such motion presumably comes as a minor involuntary action.

The amplification of such motion is very great because of the flexibility of the rod. The motion of the orb is simple harmonic, and mechanically resonant. The amplitude of the motion of the handle may therefore be very small, even though the amplitude of the motion of the orb is two or three centimeters.

The flexibility of the rod is related to the weight of the orb in the consideration of the amplification.

I claim:

1. A game implement comprising;
(a) a hollow, transparent elongated handle (1), having an interior surface at least a part of which is transversely curved relative to the longitudinal extent thereof,
(b) a liquid (2) sealed within said handle, in an amount to form a gas bubble between the liquid and the interior surface of said handle,
(c) an elongated flexible rod (3) coaxially attached to said handle, and
(d) a body (4) attached to the end of the rod that is away from said handle,
the flexibility of said rod related to the weight of said body such that imperceptible motion of said handle produces perceptible motion of said body.

2. The game implement of claim 1, in which;
(a) the solid elements of the implement are fabricated of polycarbonate-like plastic.

3. The game implement of claim 1, in which;
(a) said body has a spherical shape.

4. The game implement of claim 1, in which;
(a) said body has a pyramidal shape.

5. The game implement of claim 1, in which;
(a) said body has the shape of a flat paddle with perforations therein.

6. The game implement of claim 1, in which;
(a) said liquid occupies approximately nine-tenths of the volume of said hollow handle.

7. The game implement of claim 1, in which;
(a) said liquid is largely water, with a small amount of glycerol.

8. The game implement of claim 7, which additionally includes;
(a) a coloring agent, in an amount less than the amount of said glycerol.

9. The game implement of claim 7, which additionally includes;
(a) acetic acid, in an amount very much less than the amount of said glycerol.

* * * * *